US006530486B1

(12) United States Patent
Batting et al.

(10) Patent No.: US 6,530,486 B1
(45) Date of Patent: Mar. 11, 2003

(54) PEGBOARD ASSEMBLY

(75) Inventors: Robert D. Batting, Barrington, RI (US); Keith M. G. Bibby, Mansfield, MA (US); Robert H. Hesford, Wakefield, RI (US)

(73) Assignee: Kenney Manufacturing Company, Warwick, RI (US)

( * ) Notice: Subject to any disclaimer, the term of this patent is extended or adjusted under 35 U.S.C. 154(b) by 150 days.

(21) Appl. No.: 09/648,443

(22) Filed: Aug. 25, 2000

(51) Int. Cl.[7] ..... A47F 5/00

(52) U.S. Cl. ..... 211/57.1; 211/59.1; 211/86.01; 248/220.41

(58) Field of Search ..... 211/57.1, 59.1, 211/183, 87.01, 106, 86.01, 94.01; 248/220.21, 220.31, 220.41, 220.42, 220.43, 222.51, 223.31, 224.61

(56) References Cited

U.S. PATENT DOCUMENTS 2,926,824 A * 3/1960 St. Clair
3,002,630 A * 10/1961 Heisser
3,778,955 A * 12/1973 Close
3,833,090 A * 9/1974 Georgianna ..... 248/243
3,854,588 A * 12/1974 Kinard ..... 248/13.1
4,450,936 A * 5/1984 Strom ..... 248/221.2
4,509,648 A * 4/1985 Govang et al. ..... 211/87.01
4,726,554 A * 2/1988 Sorrell ..... 248/222.2
5,180,128 A * 1/1993 Massey ..... 248/220.4
5,397,087 A * 3/1995 Teece ..... 248/221.1
5,415,370 A * 5/1995 Valiulis ..... 248/220.4
5,423,436 A * 6/1995 Morrow ..... 248/220.4
5,722,625 A * 3/1998 Kenney ..... 248/220.41
5,927,517 A * 7/1999 Lipman et al. ..... 211/87.01
5,944,294 A * 8/1999 Baer ..... 248/220.43
RE36,669 E * 4/2000 Zilincar, III ..... 211/86.01
6,119,878 A * 9/2000 Zen ..... 211/94.01
6,164,467 A * 12/2000 DePottey et al. ..... 211/189

* cited by examiner

*Primary Examiner*—Daniel P. Stodola
*Assistant Examiner*—Jennifer E. Novosad
(74) *Attorney, Agent, or Firm*—Robert J. Doherty

(57) ABSTRACT

A pegboard assembly adapted for the receipt of standard hook and rod devices in both ¼ inch and ⅛ inch thickness which engages the hook portion of such devices at both a vertically disposed front plate and a horizontally disposed top plate so as to insure both firm support and resistance to lateral shift.

10 Claims, 4 Drawing Sheets

PEGBOARD ASSEMBLY

BACKGROUND OF THE INVENTION

This invention relates to an improved alternate for existing type pegboard structures, that is, the type of structure in which a wood composition board with a plurality of holes provided therein is vertically mounted on a surface for the receipt of hook and peg members which extend into the holes and whereby articles may be supported from the forwardly projecting portions thereof. The wallboard portions of such systems are commonly referred to as pegboard while the devices generally formed from generally circular metal rod stock that extend into the pegboard openings and which support articles thereon are commonly referred to as hook and peg devices. Such mounting devices include a peg portion which in most cases is in the form of a pair of laterally-spaced fingers which are adapted to extend through a pair of adjacently spaced openings in the pegboard and a hook or rod normally integrally connected to the fingers which extend outwardly from the board surface and on which articles are adapted to be suspended or supported. For purposes of clarity, the fingers or hooks which extend into the holes of the board will be referred to as "hooks" and the hooks or rod supporting means outwardly extending from the board surface will be referred to as the support rod, element or more generally a forward projecting member.

The above referred to hook and rod assemblies are widely available in either of two alternative thickness dimensions of ⅛ inch or ¼ inch diameter. There are, accordingly, vast numbers of these hook and rod assemblies in existence—most of which are not in use simply because the pegboard on which they were originally mounted has deteriorated, has been discarded for reasons of inconvenience or unsightliness or not worth removing when the owner moves to a new location. The owner normally is hesitant to discard the perfectly good hook and rod mounting devices and thus a huge inventory of these devices await productive use.

A common pegboard type and the hook and rod devices supported thereon is shown in FIGS. 1 and 2 of the present application. There are a significant number of alternate or related constructions including that shown in U.S. Pat. No. 5,180,128 to Massey in which the hook and rod device is of two separable parts, that is, the peg portion being retained in the pegboard when the rod portion is removed or exchanged. In addition, it is common to form the peg portion of such two-part systems in a variety of ways to receive separate hook or hanger mechanisms such as shown in U.S. Pat. Nos. 3,985,325; 4,726,554 and 4,026,508. Other systems wherein the board openings take on various forms as dictated by the shape of the hooks or fingers adapted to extend therein such as that system shown in U.S. Pat. No. 5,379,976 are common. Other variations of a pegboard assembly include retaining means for the hook and peg devices that extend rearwardly of the pegboards such as that shown in U.S. Pat. No. 5,927,517.

In addition to the above structures set forth in the above-recited patents, there are pegboard related systems such as those shown in U.S. Pat. No. 2,926,824 to St. Clair that present hanger mechanisms configured to attach to mounting plates in such a fashion that a more stable lateral positioning is achieved, that is, the hanger is materially prevented from undesirably swinging laterally back and forth with respect to the mounting plate. U.S. Pat. No. 2,926,824 accomplishes such lateral positioning by receiving a portion of the hanger rod within a reduced diameter V-hole slot while that the construction shown in U.S. Pat. No. 5,415,370 accomplishes the same objective by fixing the hanger position by contact with two rearwardly spaced openings.

In light of the above, a primary object of the present invention is to provide a better, stronger and longer lasting replacement for standard pegboards. A further object of the present invention is to provide a pegboard replacement that more stably supports the hook and peg device associated therewith. A still further object of the present invention is to provide an improved pegboard replacement that accommodates the alternate sized hook and peg assemblies presently available such that the large existing inventory of such devices can be utilized. A still further object of the present invention is the provision of an improved mounting device for receiving the presently existing shapes and sizes of hook and peg assemblies which mounting assembly is relatively inexpensive but long lasting and aesthetically attractive.

These and other objects are accomplished by a pegboard assembly for use in combination with hook and rod devices of the type having a connecting portion including a pair of laterally spaced rearwardly extending hooks each terminating in an upwardly extending finger and an article supporting portion including a forwardly projecting member connected at its base with said connecting portion and adapted to forwardly extend from the surface on which said device is mounted so as to enable articles to be supported thereby, said assembly comprising a body including a generally vertically oriented base adapted to contact a vertical supporting surface for attachment thereto, a generally vertically oriented face plate connected to said base and spaced forwardly thereof, and a generally horizontally oriented top plate disposed rearwardly of the top edge of said front plate, both said front plate and said top plate having a plurality of laterally spaced holes wherein vertically adjacent holes of both said plates are generally aligned with each other for receipt of the hooks of one of said hook and rod devices, said top plate opening including a forwardly disposed finger contacting peripheral edge surface wherein each of the hook fingers extend rearwardly through a face plate opening and then upwardly through the adjacent top plate opening so as to contact portions of the contact edge surface of said top plate opening at two laterally spaced locations thereby positioning said hook finger with respect to said assembly.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
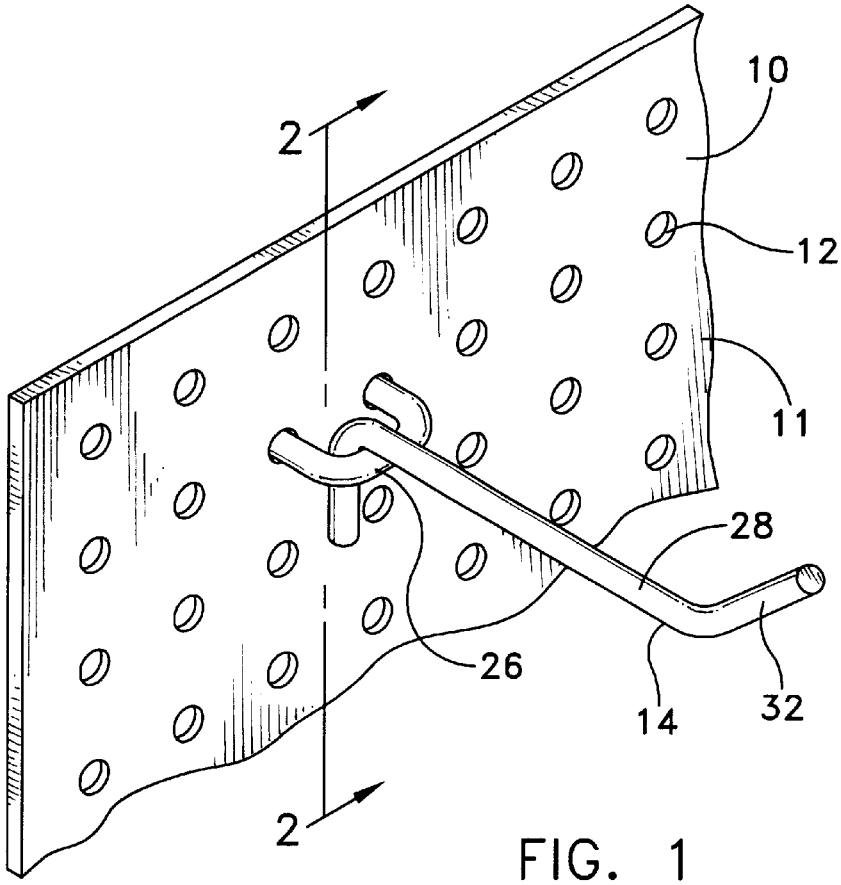
FIG. 1 (PRIOR ART)
FIG. 1 is a partial perspective view showing a prior art pegboard and a conventional hook and peg device attached thereto in the normal manner.
Figure 2:
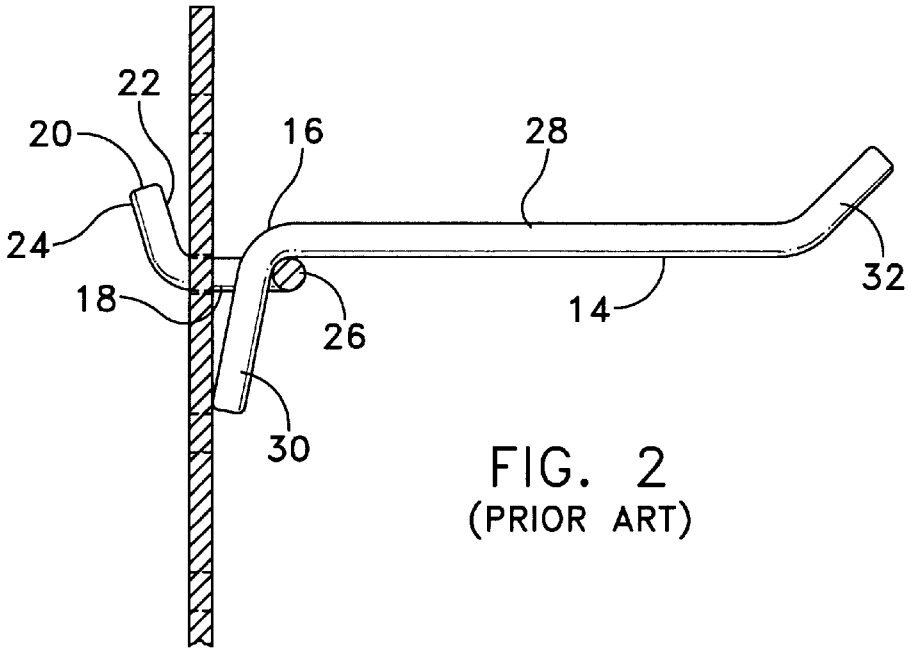
FIG. 2 (PRIOR ART)
FIG. 2 is a side sectional view along the line 2—2 of FIG. 1.

Referring to the drawings and particularly FIGS. 1 and 2 thereof, a conventional pegboard 10 is depicted as attached to some supporting surface such as a wall (the conventional attachment means such as nails, screws and the like not shown). The pegboard 10 is normally formed from a wood or paperboard composition and has a face 11 in turn provided with a plurality of openings 12 aligned both laterally and vertically such that they may receive a hook and rod device 14 of conventional configuration in the manner depicted. Such hook and rod devices include a central portion 16 generally from which a pair of rearwardly extending hooks 18 extends. Some devices include only a single hook 18 and the assembly of the present invention will also accommodate such form as well. Such hooks 18 terminate in upwardly extending fingers 20 having forward and rearward facing surface portions 22 and 24 respectively. The central portion 16 includes a base member 26 to which a forwardly projecting member 28 is connected as by welding and the like and includes a downwardly extending member 30 which in most cases with prior art assemblies contacts the face 11 of the pegboard 10 so as to provide a positive stop to continued forward rotation of the mounted device. These hook and rod assemblies 14 are conventional and are normally formed from metal rod stock and thus present a cylindrical cross-sectional configuration. These hook and rod devices or assemblies normally are generally available in two sizes—one in which the rod stock is ¼ inch in diameter and the other in which the stock is ⅛ inch in diameter to meet the needs of heavy duty, professional and industrial applications and general homeowner or light duty use respectively. The forwardly projecting portion 28 may terminate in an upwardly extending finger 32 and may assume various other shaped configurations (not shown) including that of a U-shaped hook and that of a narrow flat plate to support shelving and the like.

An important consideration is not so much the particular configuration of the forward portion of the hook and rod device since there are numerous configurations presently available for various end use applications but that these devices are intended for use with conventional pegboards. Since these pegboards are constructed of somewhat soft breakable material which can also disintegrate over time and become otherwise unsightly and/or unusable, many of such pegboards are no longer utilized and have been discarded thus leaving a huge inventory of the hook and rod assemblies no longer used and generally stored in drawers or boxes awaiting to be discarded. The present invention is directed to a unique assembly which can utilize that vast inventory of hook and rod assemblies that presently exists as well as those that are currently being manufactured to fit therewith in a manner which not only affords a more stable receipt and therefore positioning of the hook and rod assemblies vis-à-vis the assembly but which accommodates both ⅛ inch and ¼ inch hook and rod devices with ease.

Turning now to the drawings and particularly FIGS. 3 through 7 thereof, the unique pegboard mounting assembly 50 of the present invention is depicted in conjunction with the support of a standard hook and peg device 14 of the thicker, i.e., ¼ inch, diameter stock. The mounting assembly 50 includes a face plate 52 having a front surface 54 provided with at least one laterally extending row of spaced normally circular openings 56. Such row of openings 56 is disposed proximal to the top edge of the face plate 52 and are adapted to receive the laterally spaced hooks 18 of the standard hook and rod device 14. The diameter of the normally circular openings 56 is slightly larger than ¼ inch.

The assembly 50 includes a base 58 having a supporting surface which may take the form of a pair of vertically spaced lower and upper base plates 60 and 62 respectively which include inner surfaces adapted to contact the supporting wall and through which the assembly 50 may be attached thereto by conventional attachment means such as nails, screws and the like. The face plate 52 is connected to the base 58 by means of a bottom plate 64 and top plate 66. The bottom and top plates 64, 66 serve to connect the face plate 52 to the base and forwardly space such face plate 52 from the supporting wall such that the fingers 20 of the hook and rod device 14 may extend behind the surface of the face plate 52. It should be brought out that the assembly 50 is fashioned from a stiff rigid material such as metal stock and normally bent into shape and provided with a wear and rust resistant decorative and protective coating. In comparison with prior art pegboards 10 in which it is sometimes difficult to push the hook and rod fingers through their openings so as to position them behind the front surface thereof (although the flexible nature of the pressboard material from which such prior art devices were formed accommodated such to some extent) such problem is eliminated with the present system since the assembly provides for the sufficient clearance between the base 58 and the face plate 52 to accommodate the hooks. Also, the tendency to only mount such pegboard assemblies in informal locations such as across open studding in a garage or other unfinished locations is not required with the present invention. Also, the use of a spacing frame to which prior art pegboards are sometimes mounted is further eliminated.

Figure 3:
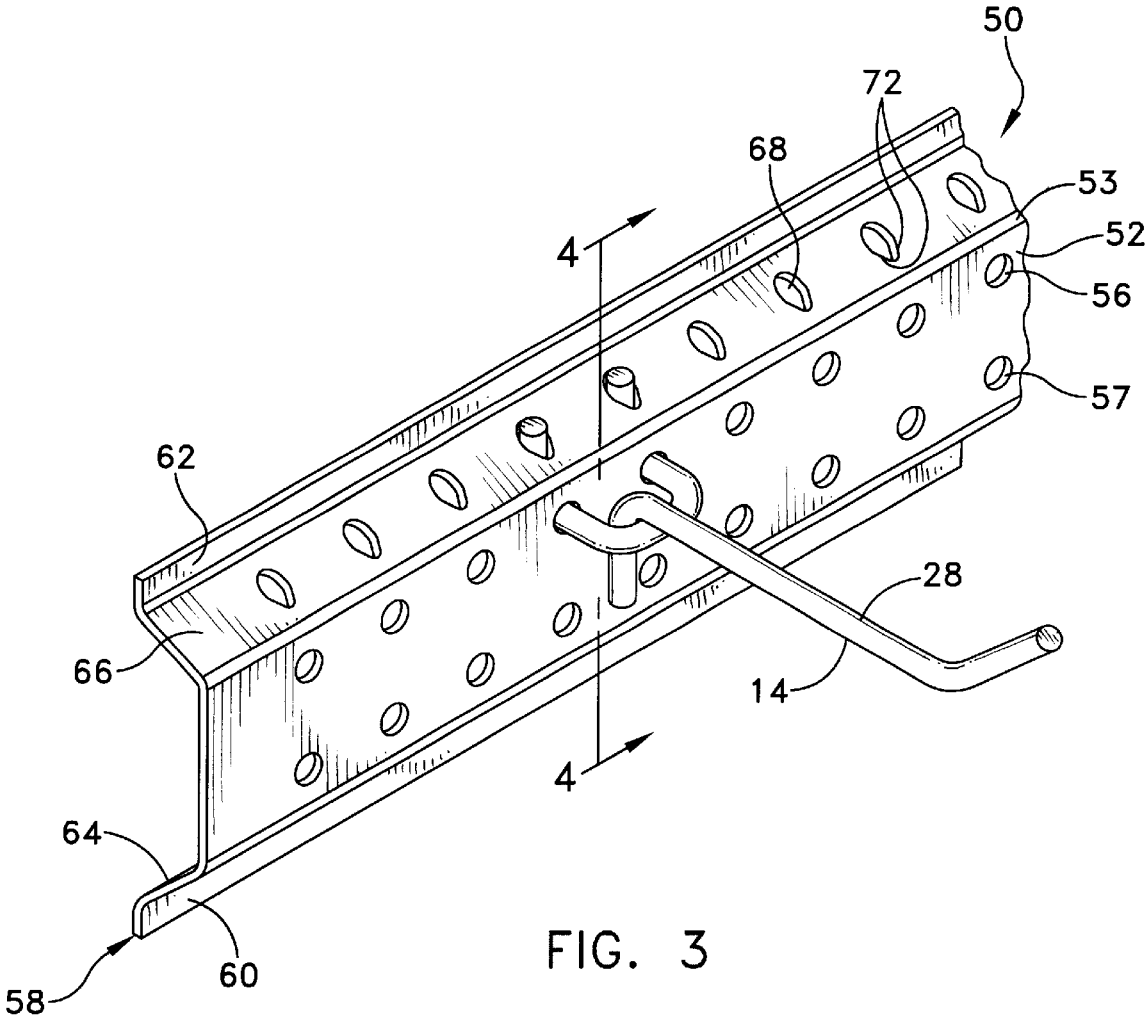
FIG. 3 is a partial front perspective view showing the improved mounting assembly of the present invention and the manner in which existing prior art conventional hook and peg devices can be mounted thereon.
Figure 4:
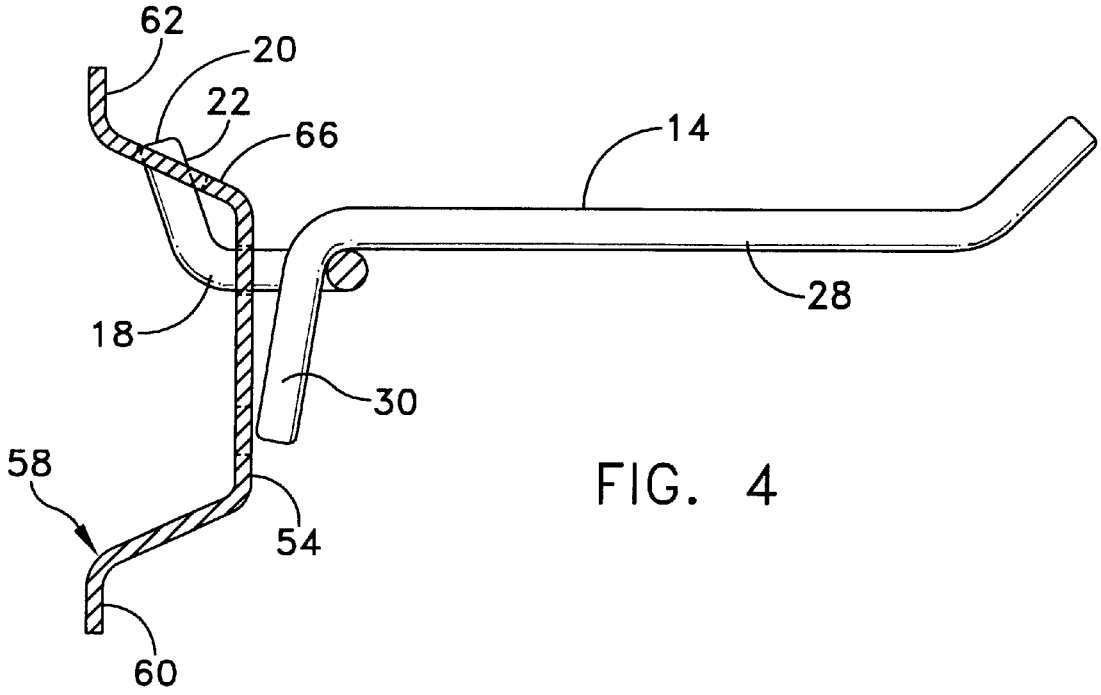
FIG. 4 is a side sectional view along the line 4—4 of FIG. 3.
Figure 5:
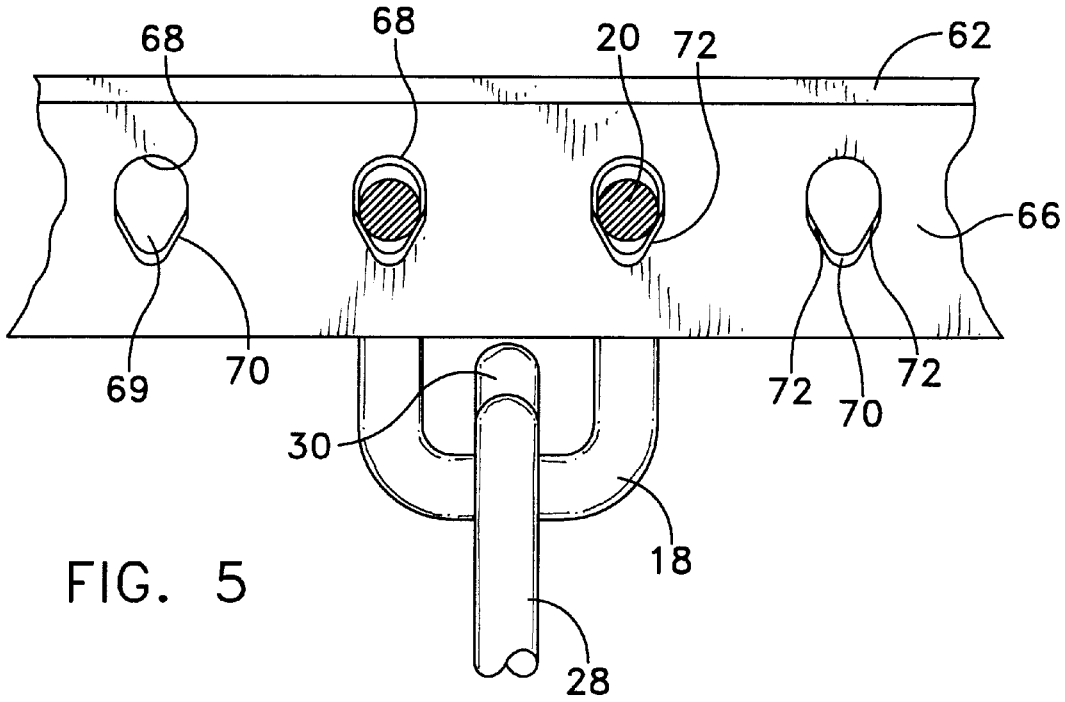
FIG. 5 is a top plan view of FIG. 3.
Figure 6:
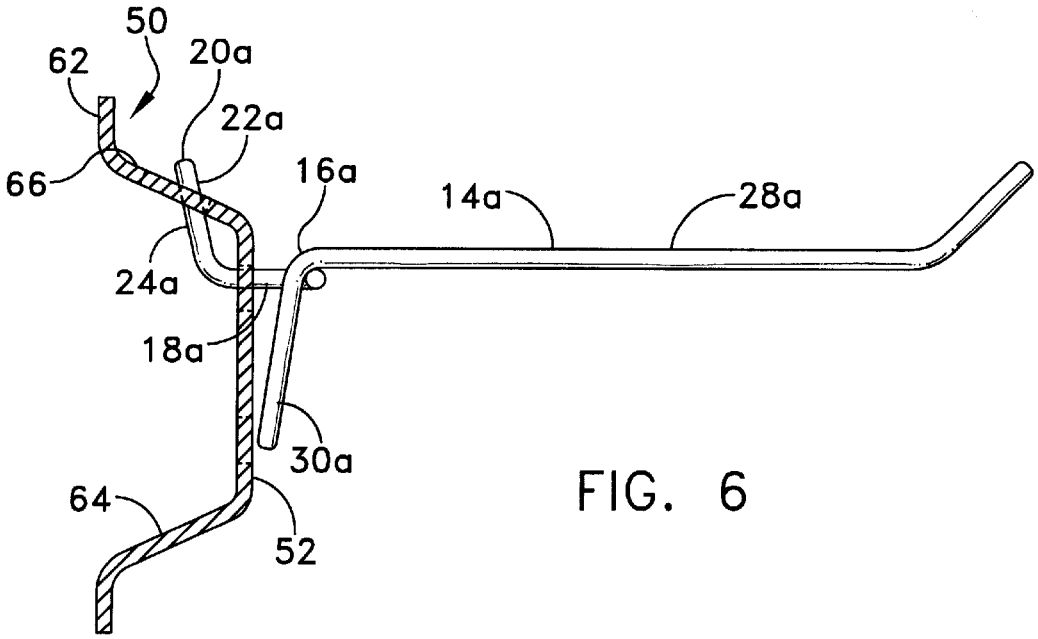
FIG. 6 is a side sectional view showing the same improved mounting assembly of the present invention shown in FIGS. 3 through 5 but showing a smaller diameter hook and peg device mounted therein.
Figure 7:
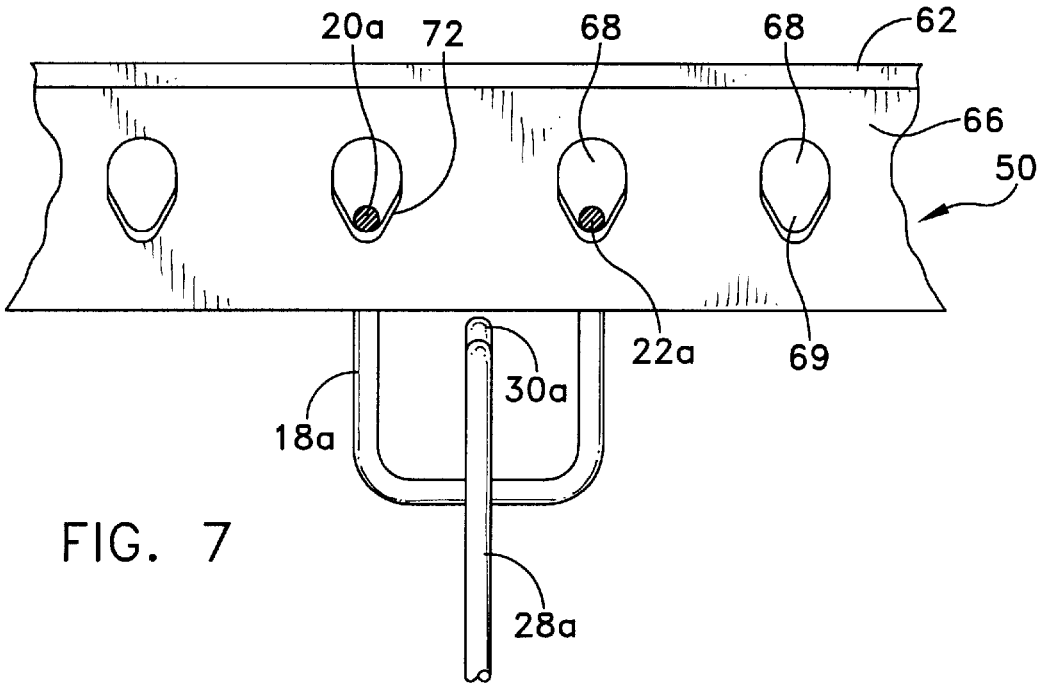
FIG. 7 is a top plan view of FIG. 6.

While the angular relationship with respect to the lower plate 64 and the face plate 52 is unimportant as long as the necessary clearance space between the mounting surface and the assembly 50 as mentioned above is provided, top plate 66 should assume a relatively generally horizontally oriented relationship to the face plate 52 such that the terminal portions of the fingers may upwardly extend into and through a pair of laterally spaced openings 68 provided through the surface thereof. Such openings 68 are of a diameter slightly larger than ¼ inch so as to accommodate the larger diameter of the two standard hook and rod devices commonly in use and include a laterally narrowed forward peripheral edge surface 70 such that the forward portions 22 of the upwardly extending fingers 20 contact the central portions comprised of laterally separated segments of such peripheral edge surface 70 when the rod and support devices of ¼ inch diameter as shown in FIGS. 3 through 5 and forward portions of the peripheral edge surfaces 70 when the hook and support device is formed of the smaller, that is, ⅛ inch, diameter stock as shown in FIGS. 6 and 7. In this way not only does an assembly provided with only one size openings accommodate the two differently sized hook and rod devices previously referred to but also assures that contact between the top plate 66 and the hook portion of the hook and peg device is at two laterally spaced locations so as to provide lateral stability and thus eliminate side to side movement of the peg portion vis-à-vis the supporting surface. Such undesirable side to side movement is commonplace with prior art pegboard systems since they normally only provide lateral support via contact with the edges of the holes 12 as opposed to the present invention of incorporating not only such conventional lateral support but additional lateral support through contact with the top plate 66, thus essentially eliminated side to side movement. Thus solid support at two vertically spaced locations is provided. Furthermore as the finger forward portions 22 contact peripheral edge surface portions 70 of the openings 68, a positive stop to further downward rotation of the peg portion of the hook and peg device is provided thus eliminating the need for the member 30 often provided in the available prior art devices. The configuration and relative dimensioning of the present assembly 50 takes such in consideration such that contact of the member 30 with the face plate 52 is unnecessary and assures that the fingers 20 contact the top plate 66 prior or at least simultaneously with such possible contact between member 30 and face plate 52.

In order to mount the support device 14 to the assembly 50, it is simply tilted such that the forward portions of the fingers 20 extend into a pair of openings 56 and thence the device is downwardly tilted so as to position the fingers through a pair of openings 68. Thereafter, downward pressure on the rod 28 forces the fingers into contact with the finger contacting peripheral edge surface 70 either by the positioning pressure of the user or by the weight of articles retained thereon. The peripheral edge surface portions 70 are formed by laterally spaced segments 72 since the mouth of the narrowed forward portion 69 of the opening 68 is dimensioned such the ¼ inch fingers are too large to completely fit therein. Accordingly, the fingers 20, in essence, simultaneously contact the segments 72 on each side of the finger when the finger is positioned in its normal use position, that is, in its most forwardly disposed position as limited by contact with the segments 72. It is thus apparent that this finger/segment contact will additionally provide lateral stability to the device as so mounted in the assembly of the present invention. Downwardly extending member 30 may, however, in some cases provide some additional stability by contacting the front surface 54 of the face plate 52.

In some cases, it is desirable to provide an additional set of laterally-spaced openings 57 positioned vertically downward from the openings 56 to accommodate existing hook and rod devices with longer or otherwise differently configured fingers. It should also be pointed out that while the cross-sectional configuration of the assembly 50 as depicted is the preferred embodiment, other formations or configurations can be utilized so long as they is support the face plate 52 forwardly spaced from some base which affords a connection with the supporting wall and the further position of the top plate 66 adjacent the upper edge of the face plate 52 and extending rearwardly thereof in either a horizontal or slightly upwardly rearwardly extending direction, that is, substantially horizontally disposed with regard thereto, such that insertion and accommodation in a mounted position of the fingers 20 is afforded. In other words in some cases it would be unnecessary to even connect the top plate 66 to the face plate 52 via the top edge 53 as in a case where the base wall was integrally connected to the face wall via a U-shaped connecting portion and provided the top wall as a forwardly projecting portion thereof—the point being that the important features being those heretofore discussed.

Turning now to FIGS. 6 and 7 of the drawings, the assembly 50 of the present invention is shown in receipt of a narrower diameter hook and support device 14*a*. Connection and support with regard to the narrower diameter, i.e., ⅛ inch diameter, device 14*a* is essentially the same with respect to the device 14 previously mentioned except the narrower diameter of the finger 20*a* enables the front face 22*a* thereof to project further into the narrowed forward portion 69 of the opening 68 to contact forward portions of the peripheral edge surface thereof. As previously indicated with reference to FIGS. 3 through 5 of the drawings, the hook and support device 14*a* includes a central portion 16*a* generally from which a pair of rearwardly extending hooks 18*a* extend. Some devices include only a single hook 18*a* and the assembly of the present invention will accommodate such form as well. Such hooks 18*a* terminate in upwardly extending fingers 20*a* having forward and rearward facing portions 22*a* and 24*a* respectively. Central portion 16*a* includes a base member 26*a* to which a forwardly projecting member 28*a* is connected as by welding and the like and includes a downwardly extending member 30*a* which in most cases with prior art assembly contacts the face 11 of the pegboard 10 so as to provide a positive stop to prevent continued forward rotation of the mounted device. Also as previously mentioned, the device 14*a* is of the narrower diameter form, i.e., ⅛ inch diameter. The same lateral support and the same vertical (anti forward rotational) support is provided as discussed with relation to FIGS. 3–5. It should be mentioned, however, that while in FIGS. 3–5 the larger diameter finger contacts the spaced segments 72, the contact with regard to the smaller diameter finger in FIGS. 6 and 7 is at both side and generally front portions of the generally U-shaped portion of the contact edge surface 70 disposed between segments 72 and, in essence, serving to connect such segments such that the contact edge surface 70 is of continuous extent. Of course if the front portion does not permit full receipt of the finger, then contact at the sides as in the case of FIGS. 3–5 will occur.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A pegboard assembly in combination with hook and rod devices, each of said devices having a connecting portion including a pair of laterally spaced rearwardly extending hooks each terminating in an upwardly extending finger and an article supporting portion including a forwardly projecting member connected at its base with said connecting portion, said assembly comprising; a body including a generally vertically oriented base adapted to contact a vertical supporting surface for attachment thereto, a generally vertically oriented face plate connected to said base and spaced forwardly therefrom, and a top plate disposed rearwardly of said face plate, both said face plate and said top plate having a plurality of laterally spaced openings wherein vertically adjacent openings of said top plate and said face plate are generally aligned with each other for receipt of the hooks of one of said hook and rod devices, such that when said hook fingers of said device are inserted into a pair of said openings in said face plate and when said article supporting portion of said device is oriented perpendicularly with respect to the plane of said face plate, the hook fingers additionally extend upwardly through the respective openings in the top plate thereby positioning said device with respect to said assembly.

2. The assembly of claim 1 wherein said top plate openings include a main central portion and a narrowed forward portion to form a keyhole configuration.

3. The assembly of claim 2 wherein said main central portion being of a diameter larger than ¼ inch and the narrowed forward portion of a diameter larger than ⅛ inch but smaller than ¼ inch.

4. The assembly of claim 1 said base having upper and lower base plates vertically separated from each other and each connected to said face plate.

5. The assembly of claim 1 wherein said top plate openings include a main central portion and a narrowed forward portion, said main central portion including laterally spaced segments adapted to contact larger diameter fingers and said forward portion disposed between said segments and adapted to contact smaller diameter fingers.

6. A pegboard assembly in combination with hook and rod devices; each of said devices having a connecting portion including at least one rearwardly extending hook terminating in an upwardly extending finger and an article supporting portion including a forwardly projecting member connected at its base with said connecting portion, said assembly comprising; a body including a generally vertically oriented base adapted to contact a vertical supporting surface for attachment thereto, a generally vertically oriented face plate connected to said base and spaced forwardly thereof, and a top plate disposed rearwardly of said face plate, both said face plate and said top plate having a plurality of laterally spaced openings wherein vertically adjacent openings of said top plate and said face plate are generally aligned with each other for receipt of said at least one hook of one of said hook and rod devices, such that when said at least one hook finger of said device is inserted into one of said openings in said face plate and when said article supporting portion of said device is oriented perpendicularly with respect to the plane of said face plate, the hook finger additionally extends upwardly through the respective openings in the top plate thereby positioning said device with respect to said assembly.

7. The assembly of claim 6 wherein said top plate openings include a main central portion and a narrowed forward portion to form a keyhole configuration.

8. The assembly of claim 6 said base having upper and lower base plates vertically separated from each other and each connected to said face plate.

9. The assembly of claim 6 wherein said top plate openings include a main central portion and a narrowed forward portion, said main central portion including laterally spaced segments adapted to contact larger diameter fingers and said forward portion disposed between said segments and adapted to contact smaller diameter fingers.

10. A pegboard assembly for the mounted receipt of hook and rod devices having a connecting portion including a pair of laterally spaced rearwardly extending hooks each terminating in an upwardly extending finger and an article supporting portion including a forwardly projecting member and a base in turn connected at its base with said connecting portion, said assembly comprising; a body including a generally vertically oriented base adapted to contact a supporting surface for attachment thereto, a generally vertically oriented face plate connected to said base and spaced forwardly therefrom and a top plate disposed rearwardly of said face plate, both said face plate and said top plate having a plurality of laterally spaced openings wherein vertically adjacent openings of said top plate and said face plate are generally aligned with each other for receipt of the hooks of one of said hook and rod devices such that when said hook fingers of said device are inserted through a pair of said openings in said face plate and when said article supporting portion or said device is then oriented perpendicularly with respect to the plane of said face plate, the hook fingers additionally extend upwardly through and contact the respective openings in the top plate thereby positioning said device with respect to said assembly.

* * * * *